US011939782B2

(12) United States Patent
Boyd et al.

(10) Patent No.: US 11,939,782 B2
(45) Date of Patent: Mar. 26, 2024

(54) WALL-MOUNTABLE PERCH

(71) Applicant: AAA ROYAL CONSTRUCTION LLC, Weymouth, MA (US)

(72) Inventors: Joseph John Boyd, Braintree, MA (US); Michael Aziz Allie, Weymouth, MA (US)

(73) Assignee: AAA Royal Construction LLC, Weymouth, MA (US)

( * ) Notice: Subject to any disclaimer, the term of this patent is extended or adjusted under 35 U.S.C. 154(b) by 382 days.

(21) Appl. No.: 17/153,707

(22) Filed: Jan. 20, 2021

(65) Prior Publication Data

US 2021/0222443 A1 Jul. 22, 2021

Related U.S. Application Data

(60) Provisional application No. 62/963,626, filed on Jan. 21, 2020.

(51) Int. Cl.
*E04G 3/18* (2006.01)

(52) U.S. Cl.
CPC ..... *E04G 3/18* (2013.01)

(58) Field of Classification Search
CPC ..... E04G 3/18; A47L 3/02
See application file for complete search history.

(56) References Cited

U.S. PATENT DOCUMENTS 480,046 A * 8/1892 Stauber ..... A47L 3/02 182/62
735,915 A * 8/1903 Sherwood ..... A47L 3/02 211/116

(Continued)

FOREIGN PATENT DOCUMENTS

CN 102216545 A * 10/2011 ..... B66B 19/00
DE 3041204 A 6/1982
FR 2600955 A 10/1991
FR 2881450 A 8/2006

(Continued)

OTHER PUBLICATIONS

Scott, Third Story Window Access Of Apartment Windows The Window Jack To The Rescue, Online Article, Apr. 15, 2017, Generational Media on Vimeo, Source Glass LLC, OneSourceGlass.com.

(Continued)

*Primary Examiner* — Brian D Mattei
*Assistant Examiner* — Jacob G Sweeney
(74) *Attorney, Agent, or Firm* — Sunstein LLP

(57) ABSTRACT

A wall-mountable perch includes: a frame including: first horizontal side members; a first cross member connected to each of the first horizontal side members proximate to a respective distal end of each of the first horizontal side members; second horizontal side members connected to the first horizontal side members; a platform connected to the second horizontal side members; a plurality of support arms each having a proximal end connected proximate to a proximal end of the frame, each support arm extending vertically upward from the frame and being configured to be flexible to bend along a respective length of each of the plurality of support arms; tension arms each connected to a respective horizontal side member; and adjusting means for producing tension in the tension arms and for causing a second cross member of the wall-mountable perch to move closer to the platform.

20 Claims, 11 Drawing Sheets

(56) References Cited

U.S. PATENT DOCUMENTS

| | | | | | |
|---|---|---|---|---|---|
| 1,197,518 | A | * | 9/1916 | McNeill | A47L 3/02 297/373 |
| 4,079,813 | A | * | 3/1978 | Ellison | A47L 3/02 182/62 |
| 5,203,426 | A | | 4/1993 | Sydnor | |
| 5,823,289 | A | * | 10/1998 | Csomos | A47L 3/02 182/62 |
| 7,108,100 | B2 | | 9/2006 | Stingl | |
| 8,622,172 | B2 | | 1/2014 | Murphy | |

FOREIGN PATENT DOCUMENTS

| | | | | | |
|---|---|---|---|---|---|
| JP | 2003147957 | A | | 5/2003 | |
| JP | 2013167083 | A | | 8/2013 | |
| WO | WO-0070169 | A1 | * | 11/2000 | E04G 3/18 |
| WO | 2010/056202 | A1 | | 5/2010 | |

OTHER PUBLICATIONS

Canadian Intellectual Property Office, Office Action, Application No. 3,165,592, dated Oct. 10, 2023, 8 pages.

* cited by examiner

WALL-MOUNTABLE PERCH

CROSS-REFERENCE TO RELATED APPLICATIONS

This application claims the benefit of U.S. Provisional Application No. 62/963,626, filed Jan. 21, 2020, entitled "WALL-MOUNTABLE PERCH," the entire contents of which are hereby incorporated herein by reference.

BACKGROUND

Construction, maintenance, and/or repair of a building often involves persons working on the exterior of the building near a window. Because many windows are well above the ground, workers often require a platform located outside of the building in the vicinity of a window frame in order to perform various tasks such as caulking the frame, installing flashing, repairing grout in brickwork, painting, etc. In order to provide a platform for the worker, scaffolding may be erected. Erecting scaffolding is time-consuming and expensive, and may come with undesirable consequences (e.g., requiring a permit and/or a police detail for supervision, and may impede pedestrian and/or motor vehicle access). Further, some window frames are not disposed in a location where it is practical to erect scaffolding (e.g., a small courtyard).

SUMMARY

An example wall-mountable perch includes: a frame configured to be inserted through a window opening in a wall, the frame including: first horizontal side members; a first cross member connected to each of the first horizontal side members proximate to a respective distal end of each of the first horizontal side members; second horizontal side members connected to the first horizontal side members; a platform connected to the second horizontal side members; a plurality of support arms each having a proximal end connected proximate to a proximal end of the frame, each support arm of the plurality of support arms extending vertically upward from the frame and being configured to be flexible to bend along a respective length of each of the plurality of support arms; tension arms each connected to a respective horizontal side member of the second horizontal side members; and adjusting means for producing tension in the tension arms and for causing a second cross member of the wall-mountable perch to move closer to the platform, the adjusting means being connected to the plurality of support arms, or to the tension arms, or to the plurality of support arms and the tension arms.

Implementations of such a perch may include one or more of the following features. The plurality of support arms is configured such that a respective length of each of the plurality of support arms is adjustable, and the adjusting means are for forcibly increasing the respective length of each of the plurality of support arms. The tension arms are configured such that a respective effective length of each of the plurality of support arms is adjustable, and the adjusting means are for forcibly decreasing a respective effective length of each of the tension arms. The adjusting means are for forcibly bending the plurality of support arms away from the platform with the at least one wall-contact member of the wall-mountable perch in direct or indirect contact with the wall. The wall-mountable perch includes a rigid brace coupled to each of the plurality of support arms. The first cross member connected to each of the first horizontal side members defines a frame width, and the rigid brace has a brace length that extends horizontally beyond the frame width. The rigid brace includes a plurality of tubes configured to receive the plurality of support arms. Each of the tension arms is connected to the rigid brace or a respective one of the plurality of support arms.

Also or alternatively, implementations of such a perch may include one or more of the following features. A proximal end of each of the second horizontal side members is connected to a respective one of the distal ends of the first horizontal side members, and each of the tension arms is connected to a respective one of the second horizontal side members proximate to a respective distal end of the respective one of the second horizontal side members. The wall-mountable perch includes securing means, connected proximate to proximal ends of the first horizontal side members, for securing the wall-mountable perch to the wall by moving at least partially in a first direction that is parallel to a second direction from the proximal end of a particular one of the first horizontal side members to the distal end of the particular one of the first horizontal side members. The wall-mountable perch includes a spacer attached to a bottom side of each of the first horizontal side members. The wall-mountable perch includes: vertical posts having first ends connected to distal ends of the first horizontal side members, the vertical posts extending downwardly from the first horizontal side members to distal ends of the vertical posts; and an exterior wall contact member attached to the vertical posts and configured to contact an exterior of the wall. The second horizontal side members include an upper pair of horizontal side members and a lower pair of horizontal side members, the upper pair of horizontal side members being attached to the distal ends of the first horizontal side members, the lower pair of horizontal side members being attached to the distal ends of the vertical posts, and the platform is attached to and spans a gap between the lower pair of horizontal side members.

Another example wall-mountable perch includes: a frame including: a plurality of horizontal side members; a first cross member connected to each of the plurality of horizontal side members displaced from a respective distal end of each of the plurality of horizontal side members and from a respective proximal end of each of the plurality of horizontal side members; a second cross member connected proximate to the respective distal end of each of the plurality of horizontal side members; a platform support connected to the plurality of horizontal side members by a plurality of vertical frame members; and a plurality of frame posts each connected to and extending downward from a respective one of the plurality of horizontal side members; a platform connected to the platform support; a plurality of fence posts connected to, and extending vertically upward from, the frame; a plurality of adjustable-length support arms each having a proximal end connected to a respective proximal end of each of the plurality of horizontal side members, each of the plurality of adjustable-length support arms extending vertically upward from a respective one of the plurality of horizontal side members; an upper wall brace coupled to each of the plurality of adjustable-length support arms; a plurality of tension arms each connected to a respective horizontal side member of the plurality of horizontal side members and each connected to the upper wall brace; and a lower wall brace movably connected to the plurality of frame posts to move horizontally relative to the plurality of frame posts; where each of the plurality of adjustable-length support arms is configured to bend due to tension provided by the plurality of tension arms as a length of each the plurality of adjustable-length support arms is increased.

Implementations of such a perch may include one or more of the following features. The plurality of tension arms includes flexible cables. Each of the plurality of adjustable-length support arms includes a ratchet mechanism configured to extend the respective adjustable-length support arm of the plurality of adjustable-length support arms. The plurality of fence posts is disposed between the plurality of horizontal side members and between the first cross member and the second cross member. The wall-mountable perch includes a spacer, the upper wall brace and the spacer being configured to have the upper wall brace slidably receive the spacer such that the upper wall brace may slide along a length of the spacer and have limited range of motion relative to the spacer in a direction transverse to the length of the spacer.

An example method of installing a wall-mountable perch includes: providing an opening through with to pass a wall-mountable perch; passing a portion of a frame of the wall-mountable perch through the opening; stabilizing the frame to a wall defining the opening; and forcing a cross member of the wall-mountable perch into direct or indirect contact with the wall.

DETAILED DESCRIPTION

Techniques are discussed herein for providing platforms to allow workers to work on an exterior of a building at or near a window opening. For example, a rigid frame may be provided that supports a platform on which a worker may stand and which may be inserted, at least partially, through an opening, such as a window opening, in a wall. The frame is configured (e.g., sized and shaped) to fit through the window opening. The frame may be rested on a window sill and clamped against the wall, e.g., below the window opening. Flexible rods may be attached to the frame extending upward on an interior side of the window. A crossbar may be coupled to (e.g., connected to and/or receiving) the rods and may be connected to tensioning cables that are also connected to the frame, e.g., at anchor points possibly near a distal end of the frame. Tension may be added to the cables, e.g., by lengthening the rods and/or shortening an effective length between the anchor points and the crossbar. The added tension will cause the rods to bend and allow the crossbar to contact the wall (e.g., above or on either side of the window opening). The tension can be increased to pull the cables taut. Also or alternatively, pads may be pushed from the crossbar against the wall to provide tension to the cables, which may cause the rods to bend away from the wall. These configurations are examples, and other configurations may be used.

Items and/or techniques described herein may provide one or more of the following capabilities, as well as other capabilities not mentioned. For example, a platform for use by a person working on or near the exterior of a window opening of a building can be secured to the building without penetrating surfaces of an interior of the building, e.g., without inserting screws or nails into a wall or floor. A wall-mountable perch may be more stable, e.g., with less platform movement in use, than previous wall-mountable perches. A wall-mountable perch may be mounted to a wall by a single person. Other capabilities may be provided and not every implementation according to the disclosure must provide any, let alone all, of the capabilities discussed. Further, it may be possible for an effect noted above to be achieved by means other than that noted, and a noted item/technique may not necessarily yield the noted effect.

Figure 1:
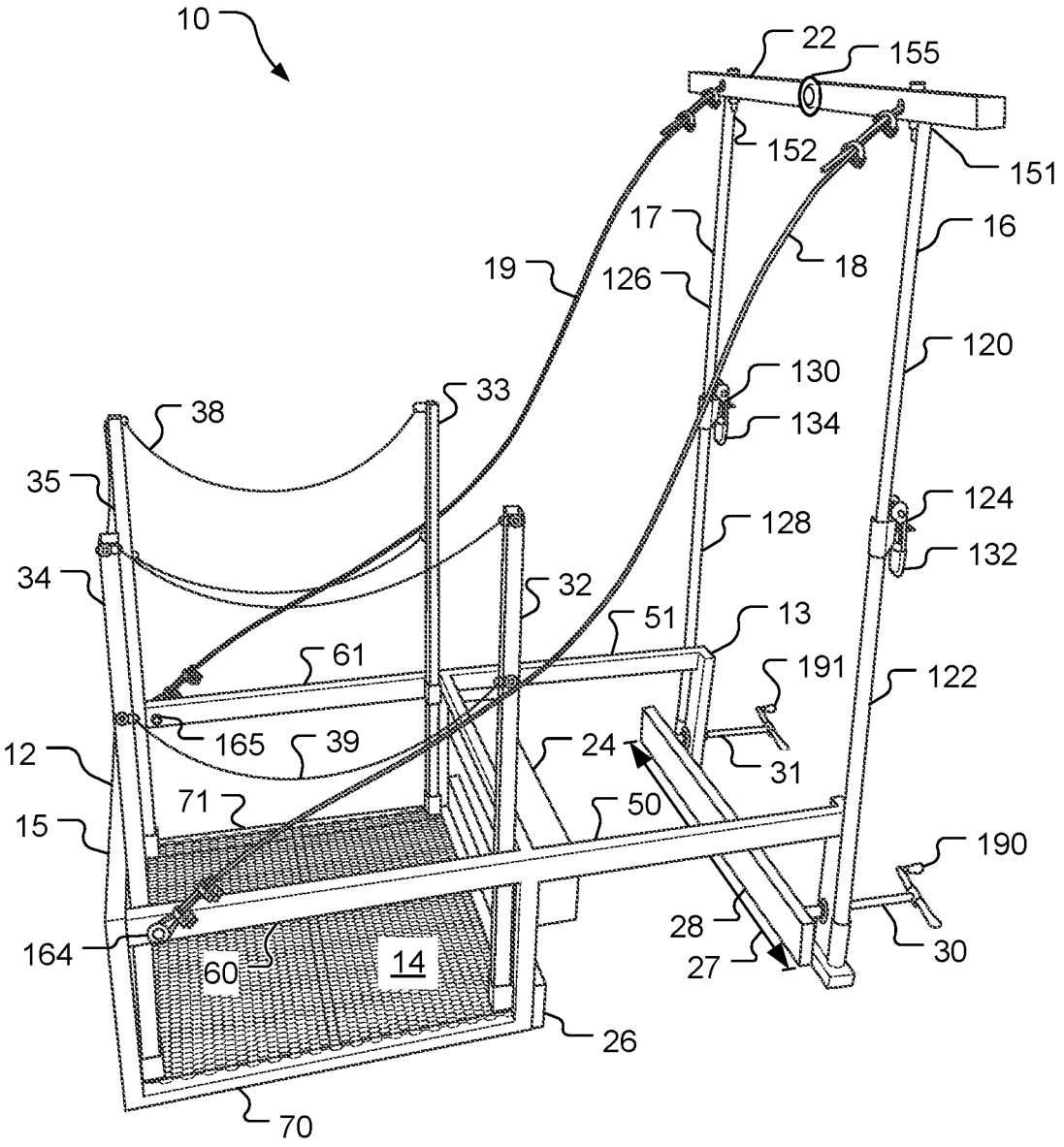
FIG. 1 is a perspective view of an example of a wall-mountable perch.
Figure 2:
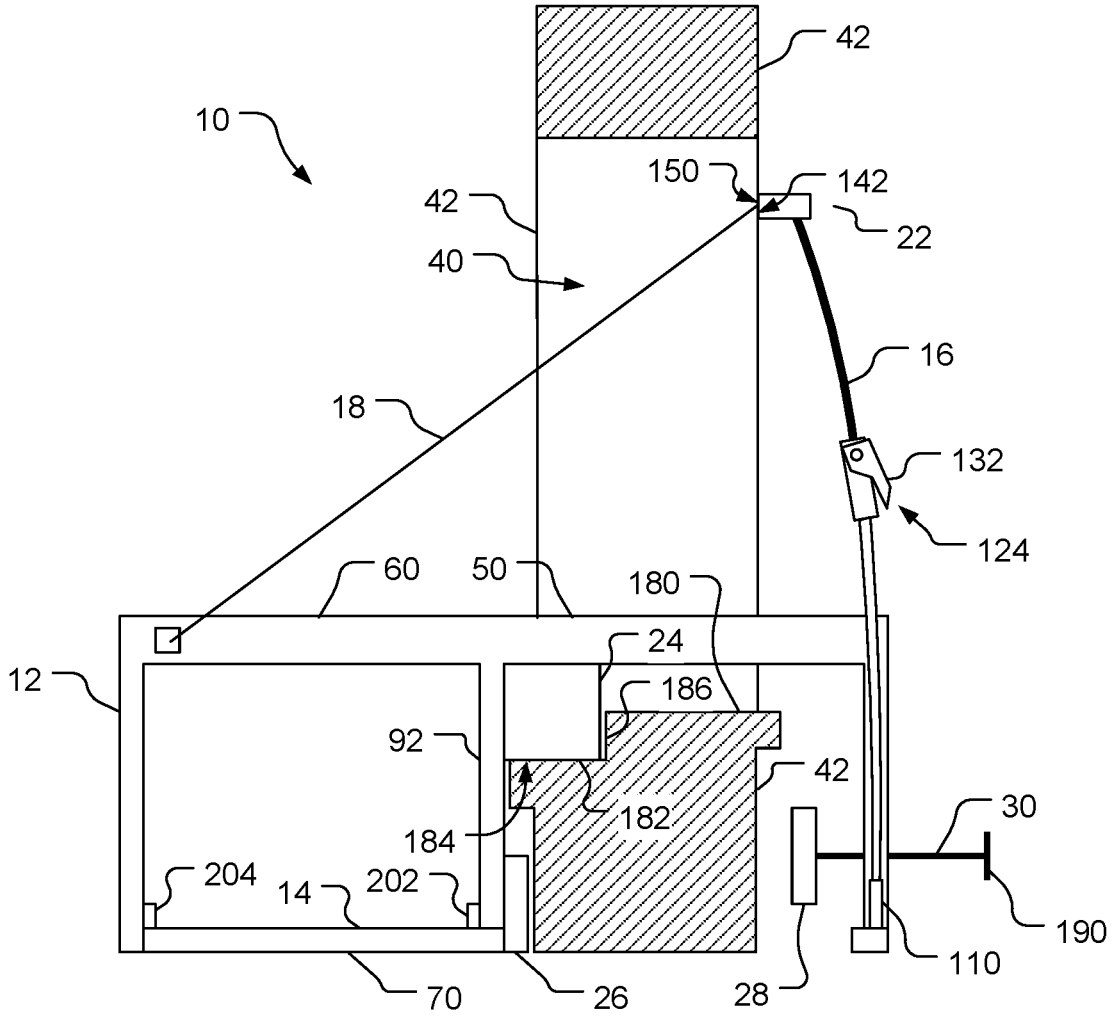
FIG. 2 is a simplified side view of the perch shown in FIG. 1 while extending through a window opening, and with a side portion of a wall providing the window opening removed.
Figure 3:
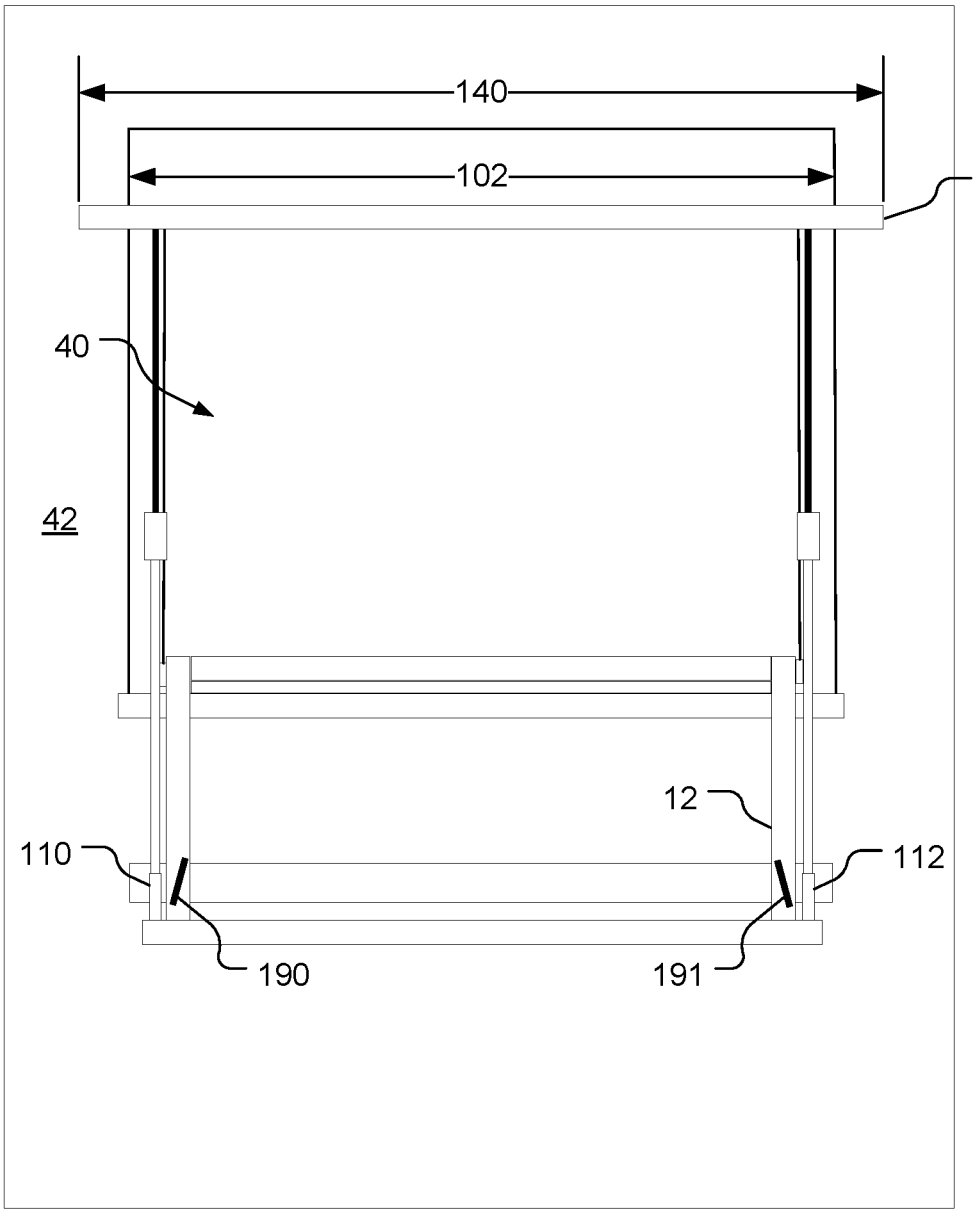
FIG. 3 is a simplified end view of the perch shown in FIG. 2, disposed through a window opening.

Referring to FIGS. 1-3, an example of a wall-mountable perch 10 includes a frame 12, a platform 14, support arms 16, 17, tension arms 18, 19, a crossbar 22, a sill spacer 24, an exterior wall pad 26, an interior wall pad 28, clamp rods 30, 31, fence posts 32, 33, 34, 35, and rails 38, 39. The perch 10 is configured to be inserted through a window opening 40 in a wall 42 of a building as shown in FIG. 2, and to be mounted to the wall 42. FIG. 2 is a side view of the perch 10 from a left-hand side of the perch 10, with a portion of the wall 42 adjacent the left side of the perch 10 (e.g., the horizontal side member 50), although present, being omitted from the figure (with the wall 42 shown in cross section but the perch 10 not shown in cross section). The wall 42 may extend below the frame 12 (e.g., see FIG. 10). The wall 42 may be a finished wall, e.g., with wooden studs covered by drywall, and the perch 10 may be configured to be mounted to the wall 42 without penetrating the building, e.g., without inserting screws or nails into the wall 42 or a floor. The perch 10 is configured to provide a sturdy platform on which a person can stand while working outside of the building, e.g., while inspecting, constructing, or maintaining (e.g., repairing, painting, etc.) the building.

The frame 12 may comprise a rigid material to help the wall-mountable perch 10 provide a stable platform on which a person may stand. In this example, the frame 12 comprises fixed-length sections, e.g., metal tubes such as steel tubes, that are fixedly attached (e.g., welded) to each other. Alternative configurations may be used, e.g., with one or more sections being adjustable in length (e.g., with one tube nesting partially in, and slidably received by, another tube), and/or with one or more connections of sections being easily breakable (e.g., with two sections being configured to be latched together with a latch that may be opened). In such cases, an adjustable-length section may be fixed at a selected length and/or the breakable connection between sections may be configured such that the selectively connected sections will have motion (e.g., sliding motion) with respect to each other restrained when connected.

Figure 4:
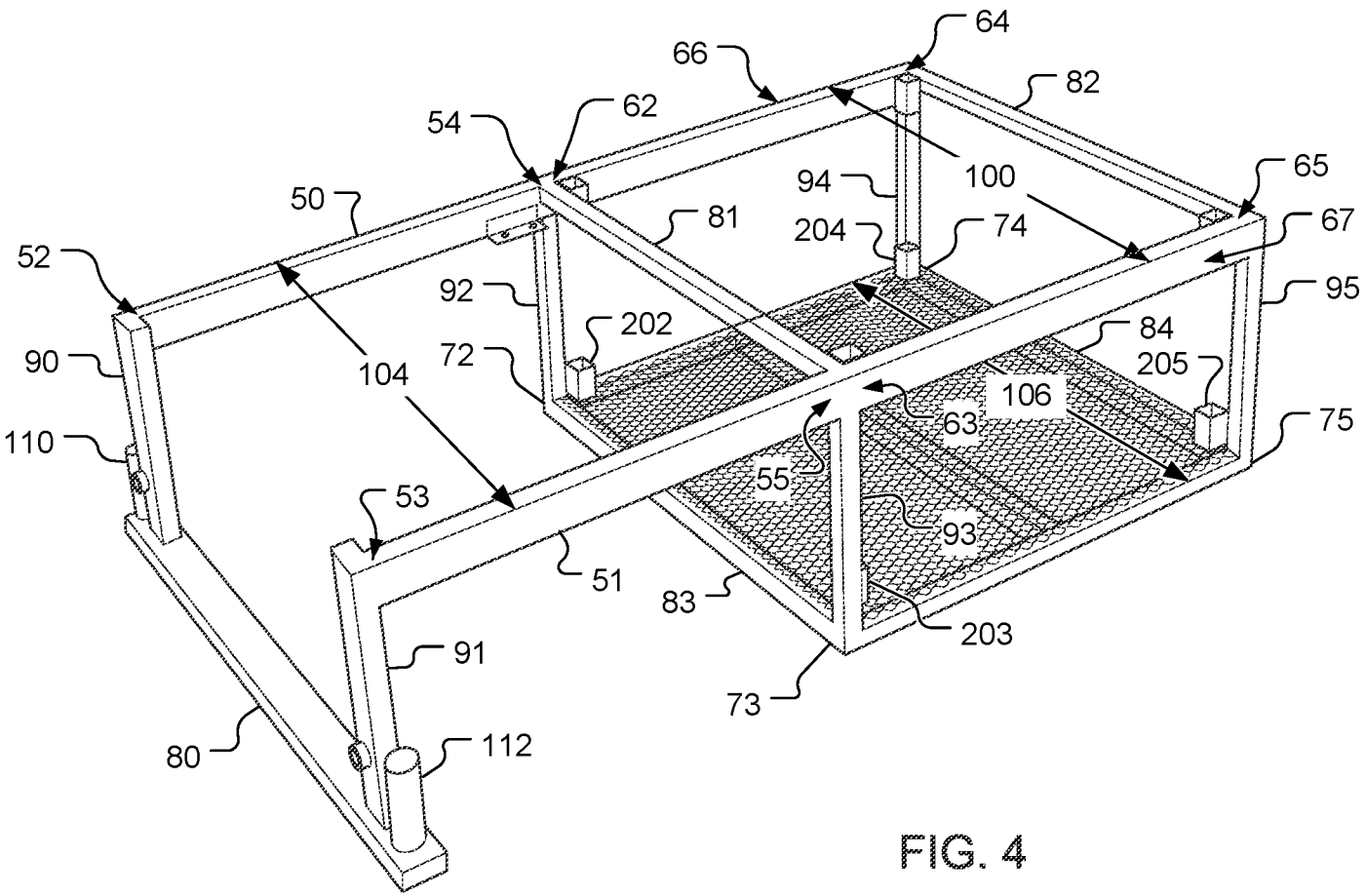
FIG. 4 is a perspective view of a frame of the perch shown in FIG. 1.

In the example of the wall-mounted perch 10, with further reference to FIG. 4, the frame 12 includes a pair of interior horizontal side members 50, 51, a pair of upper exterior horizontal side members 60, 61, a pair of lower exterior horizontal side members 70, 71, cross members 80, 81, 82, 83, 84, and vertical posts 90, 91, 92, 93, 94, 95. The interior side members 50, 51 may be integral with the upper exterior side members 60, 61, respectively, as shown, or may be separate pieces that are connected (e.g., welded, latched) together. The interior side members 50, 51 have proximal ends 52, 53 and distal ends 54, 55, respectively. The upper exterior side members 60, 61 have proximal ends 62, 63 and distal ends 64, 65, respectively. The lower exterior side members 70, 71 have proximal ends 72, 73 and distal ends 74, 75, respectively. The distal ends 54, 55 of the interior side members 50, 51 are connected to the proximal ends 62, 63 of the upper exterior side members 60, 61. The interior side members 50, 51 and the upper exterior side members 60, 61 may be considered to be a single pair of horizontal side members.

The cross members 80-84 are connected to the side members 50, 51, 60, 61, 70, 71 and to the vertical posts 90-95. The cross member 80 is connected to the vertical posts 90, 91, which are connected to, and extend downwardly from, the proximal ends 52, 53 of the interior side members 50, 51, and extend upwardly from the cross member 80. The cross member 80 and the vertical posts 90, 91 are disposed at a proximal end 13 of the frame 12. The cross member 81 is connected to the distal ends 54, 55 of, and spans a gap from (in this example, extends between), the pair of the interior side members 50, 51. The cross member 82 is connected to the distal ends 64, 65 of, and spans a gap from (in this example, extends between), the pair of the upper exterior side members 60, 61. The cross member 83 is connected to the vertical posts 92, 93, which are connected to, and extend downwardly from, the distal ends 54, 55 of the interior side members 50, 51. The cross member 84 is connected to the vertical posts 94, 95, which are connected to, and extend downwardly from, the distal ends 64, 65 of the upper exterior side members 60, 61, extend downwardly from the cross member 82, and extend upwardly from the cross member 84.

The cross members 81, 82 are connected to the side members 60, 61 such that the frame 12 has a width 100. The width 100 extends from an outside surface 66 of the upper exterior side member 60 to an outside surface 67 of the upper exterior side member 61. In this example, the frame 12 is configured such that the width 100 is less than a width 102 (see FIG. 3) of the window opening 40. In this example, a width 104 at the interior side members 50, 51 and a width 106 at the lower exterior side members 70, 71 is equal to the width 100 at the upper exterior side members 60, 61. Other configurations, however, may be used. For example, interior side members could flare outwardly such that a width of a part of the frame to be disposed inside a building while in use is larger than a part of the frame to be disposed outside the building while in use. The interior width could exceed the width 102 of the window opening 40. The width 100 could exceed the width 102 of the window opening 40, for example if the width 100 was adjustable, or if the frame was configured to have a narrow-width section (smaller than the width 102) so that the perch could be inserted through the opening 40 to have the narrow-width section disposed in the opening 40. As another example, the interior side members could define a width that is smaller than the width 100. Still other configurations are possible.

The cross members 83, 84 and the lower exterior side members 70, 71 provide a platform support to which the platform 14 is connected. The platform 14 spans a gap between the cross members 83, 84 and the lower exterior side members 70, 71. The platform 14 may be configured to hold the weight of a person and equipment used by the person, including a safety margin. The platform 14 may be configured, as in this example, to allow rain or other liquid to pass through the platform 14. Here, the platform 14 comprises a metal grate that is attached (e.g., welded) to the lower exterior side members 70, 71 and to the cross members 83, 84.

The support arms 16, 17 may be connected proximate to the proximal end 13 of the frame 12 and extend vertically upward from the frame 12, in particular from the cross member 80. In this example, the support arms 16, 17 are loosely (not fixedly) connected to the frame 12. Receiving tubes 110, 112 may be connected (e.g., welded) to and extend from the cross member 80. The receiving tubes 110, 112 may be hollow and sized and shaped to receive the support arms 16, 17, e.g., to have ends of the support arms 16, 17 inserted into the receiving tubes 110, 112. The support arms 16, 17 may be removed from the receiving tubes 110, 112 (decoupled from the frame 12) which may help make transportation and/or storage of the perch 10 more convenient.

The support arms 16, 17 may be configured to have adjustable lengths, i.e., to be adjustable-length support arms. In this example, the support arm 16 comprises an upper section 120, a lower section 122, and a securing mechanism 124, and the support arm 17 comprises an upper section 126, a lower section 128, and a securing mechanism 130. The lower sections 122, 128 and the upper sections 120, 126 may each comprise a strut, e.g., a rod or tube of rigid material that resists lengthwise compression. The lower sections 122, 128 may be tubes and the upper sections 120, 126 may be rods or tubes with the sections 120, 122, 126, 128 sized and shaped such that the upper sections 120, 126 may be slidably received by the lower sections 122, 128. The securing mechanisms 124, 130 are configured to hold the upper sections 120, 126 fixed in selected relation to the lower sections 122, 128, respectively, such that the support arms 16, 17 retain a selected length (i.e., resist contraction). For example, the securing mechanisms 124, 130 may each include a tab that fits into a selected one of a set of slots provided in a respective one of the support arms 16, 17, e.g., in a respective one of the upper sections 120, 126. The securing mechanisms 124, 130 are configured to be opened or released to allow the upper sections 120, 126 to move in relation to the lower sections 122, 128, respectively, to permit the lengths of the support arms 16, 17 to be adjusted and to restrain movement of the upper sections 120, 126 in relation to the lower sections 122, 128 with the support arms 16, 17 at desired lengths. The securing mechanisms 124, 130 may be configured to forcibly move the upper sections 120, 126 (i.e., provide a force to the upper section 120, 126 to cause the upper sections 120, 126 to move, e.g., slide) relative to the lower sections 122, 128. For example, the securing mechanisms 124, 130 may comprise ratchets and levers 132, 134 such that the levers 132, 134 may be rotated upward and then downward to cause the upper sections 120, 126 to move upwardly, away from the lower sections 122, 128.

The support arms 16, 17 are configured to be flexible to bend along lengths of the support arms 16, 17 in response to tension in the tension arms 18, 19 due to lengthening of the support arms 16, 17 as discussed more fully below. For example, the support arms 16, 17 may be configured to have distal ends 151, 152 deflect by 10% or more of lengths of the support arms 16, 17. By having the support arms 16, 17 configured to bend, the perch 10 may be mounted to a variety of window openings, e.g., with different sizes of window sills, securely to provide extra stability (e.g., beyond just the frame stability) to the perch 10. The upper sections 120, 126 and the lower sections 122, 128 may be configured to be substantially incompressible along their lengths, e.g., lengths of the sections 122, 122, 126, 128 may compress less than 5% or less than 4% or less than 1% of their respective lengths in response to a compressive force of 300 pounds (about 1330 newtons).

The support arms 16, 17 are attached to the crossbar 22. The crossbar 22 may be coupled to the support arms in a variety of ways, e.g., slidably receiving the support arms 16, 17, or being pivotally connected to the support arms 16, 17, or being fixedly connected (e.g., welded) to the support arms 16, 17, etc. For example, the crossbar 22 may be a tube (or partial tube) and may provide openings for slidably receiving ends of the support arms 16,17. The crossbar 22 may have a wall opposing the openings that inhibits the support arms 16, 17 from passing completely through the crossbar 22. Also or alternatively, the support arms 16, 17 may include members (e.g., flanges) extending outwardly from axes of the support arms 16, 17, with the members configured to interfere with the crossbar 22 to stop the insertion of the support arms 16, 17 into the crossbar 22. In the perch 10, the crossbar 22 is coupled to ends of the upper sections 120, 126 of the support arms 16, 17, but other configurations may be used. For example, the crossbar 22 may be coupled to the support arms 16, 17 some distance from the ends of the upper sections 120, 126 of the support arms 16, 17. The crossbar 22 may be pivotally connected to the support arms 16, 17 along a pivot axis about pivot pins. Alternatively, the crossbar 22 may be configured to slidably receive the support arms 16, 17, e.g., through openings and or by receiving tubes (e.g., see FIG. 9 and related discussion) that are larger than perimeters of the support arms 16, 17 to allow the crossbar 22 to rotate slightly about the support arms 16, 17.

The crossbar 22 may be configured to engage with the wall 42 to help stabilize the perch 10. For example, the crossbar 22 may be rigid, e.g., comprising a tube or partial tube of a rigid material such as aluminum or steel, and may have a length 140 (FIG. 3) that is larger than the width 102 of the window opening 40. For example, the length 140 may be about 110% of the width 102. The width 100 may be nearly the same as, but slightly less than, the width 102 for a single-wide window opening (e.g., 32 in. (81 cm), 36 in. (91 cm), 40 in. (101 cm), 44 in. (111 cm), 48 in. (121 cm), or other), and the length 140 may be about 110% or more (e.g., 115%, 120%, etc.) of the width 100 of the frame 12. For example, for a single-wide window, the width 100 may be about 78-80 cm. The crossbar 22 may be configured to help mount the perch 10 to a double-wide window opening, with the length 140 being at least twice the width 100 of the frame 12, e.g., being about 110% or more of the width of a double-wide window opening. For example, the length 140 may be about 210% or more (e.g., 220%, 230%, etc.) of the width 100 of the frame 12. The crossbar 22 may be configured to contact the wall 42 while inhibiting damaging of the wall 42. For example, the crossbar 22 may be configured to be pivotally connected to the support arms 16, 17 and have a flat contact surface 142 (FIG. 2) for engaging the wall 42. Also or alternatively, the crossbar 22 may include a soft material, e.g., rubber, at least in areas that will contact the wall 42.

The crossbar 22 may be configured to have the support arms 16, 17 engage with the wall 42. The crossbar 22 may be configured to have the length 140 be less than the width 102 of the window opening 40, and be connected to the support arms 16, 17 a distance from the ends of the support arms 16, 17 such that the support arms 16, 17 may engage the wall 42 above the window opening 40. In this case, the support arms 16, 17 are configured to extend high enough to reach the wall 42 above the opening 40, and may be configured to contact the wall 42 while inhibiting damaging of the wall 42.

The tension arms 18, 19 are, in this example, connected to the crossbar 22 and to the upper exterior side members 60, 61. In this example, the tension arms 18, 19 comprise metal cables with multiple components (threads), but this is but one example and many other configurations may be used for the tension arms 18, 19. For example, rigid members such as steel or aluminum tubes or rods may be used for the tension arms. The tension arms 18, 19 are, in this example, connected to or through a side wall 150 of the crossbar 22. The connections of the tension arms 18, 19 to the crossbar 22 may allow the crossbar to pivot relative to the tension arms 18, 19 which may facilitate the crossbar contacting the wall 42 with the contact surface 142. The tension arms 18, 19 may be connected to the upper exterior side members 60, 61 at anchor points 164, 165 proximate to the distal ends 64, 65 of the upper exterior side members 60, 61. For example, the anchor points 164, 165 may be at least midway between the proximal ends 62, 63 and the distal ends 64, 65 of the upper exterior side members 60, 61, e.g., closer to the distal ends 64, 65 than the proximal ends 62, 63, e.g., within 25% of a length of the side members 60, 61 from the distal ends 64, 65, e.g., within 10% of the length of the side members 60, 61 from the distal ends 64, 65.

The tension arms 18, 19 are configured to allow different lengths of the support arms 16, 17 while the tension arms 18, 19 are connected to the support arms 16, 17, and to resist lengthening of the support arms 16, 17 beyond a particular length. For example, here the tension arms 18, 19 are cables that can bend as the support arms 16, 17 are shortened. Other configurations may be used, however, such as rigid arms that are slidably connected to the support arms 16, 17 but that cease to slide once ends of the rigid arms are reached as the support arms 16, 17 are lengthened. Once the support arms 16, 17 reach a particular length (determined by the lengths of the tension arms 18, 19 and distances from the anchor points 164, 165 to the support arms 16, 17), the tension arms 18, 19 will resist further lengthening of the support arms 16, 17 and will pull the support arms 16, 17 with a force directed horizontally and downward. That is, each of the tension arms 18, 19 will provide a force with a horizontal component parallel to a direction from the proximal end 13 to a distal end 15 of the frame 12, and downward toward the frame 12 as the support arms are lengthened further, causing the support arms 16, 17 to bend toward the distal end 15 (e.g., toward the anchor points 164, 165). The tension arms 18, 19 may be configured such that the particular length of the support arms 16, 17 is such that the support arms 16, 17 will bend to cause the crossbar 22 to come into contact with the wall 42 below a top of the window opening 40. With the crossbar 22 in contact with the wall 42, the securing mechanisms 124, 130 may be actuated to try to further lengthen the support arms 16, 17, causing the tension arms 18, 19 to be pulled taut. This may provide great stability to the perch 10 such that the platform 14 (or at least the platform support) will move very little, e.g., imperceivably little, in response to a person walking on the platform 14.

The sill spacer 24 may be configured to position the interior side members 50, 51 above an interior window sill portion 180 and to help prevent damaging the interior window sill portion 180 and an exterior window sill portion 182. The sill spacer 24 may be connected to bottom sides of the interior side members 50, 51 and to the vertical posts 92, 93. The sill spacer 24 may be configured and disposed to rest on an exterior window sill portion 182 and may comprise a rigid or semi-rigid material in order to support the frame 12. The sill spacer 24, or at least a bottom surface 184 of the sill spacer 24, may be configured (e.g., may be smooth or semi-smooth, and/or may comprise a soft material) to help prevent damaging the exterior window sill portion 182 or a ledge 186 between the interior window sill portion 180 and the exterior window sill portion 182. In other configurations, the sill spacer 24 may provide an adjustable height, e.g., to allow the frame 12 to be moved into contact with the interior window sill portion 180.

The exterior wall pad 26 may be disposed and configured to contact an exterior of the wall 42. The exterior wall pad 26 may comprise a durable material to withstand being in contact with exterior wall surfaces such as stucco, concrete, wood, or brick, and may comprise a material to inhibit damaging of the exterior wall surface. The exterior wall pad 26 may be disposed, as in this example, at a bottom of the frame 12, connected to the lower exterior side members 70, 71 and bottom portions the vertical posts 92, 93. While in this example, the exterior wall pad 26 is fixed in place relative to the frame 12, the exterior wall pad 26 could be movably connected to the frame 12, e.g., to move toward or away from the proximal end 13 of the frame 12. This may help the perch 10 accommodate different sizes of exterior window sill sizes and shapes and/or different thicknesses of walls.

The interior wall pad 28 may be disposed, configured, and movably connected to the frame 12 to contact an interior of the wall 42. The interior wall pad 28 may comprise a durable material to withstand being in contact with interior wall surfaces such as painted drywall, paneling, tile, etc., while inhibiting damaging (e.g., scratching, marring) the interior wall surface. The interior wall pad 28 may be disposed, as in this example, at a bottom of the frame 12, connected to bottom portions the vertical posts 90, 91. Here, the interior wall pad 28 is rotatably connected to the clamp rods 30, 31 such that the clamp rods 30, 31 may be rotated without rotating the interior wall pad 28. The clamp rods 30, 31 are threaded, pass through threaded holes provided by the vertical posts 90, 91, and have proximal ends connected to handles 190, 191 to facilitate a user turning the clamp rods 30, 31. Turning the clamp rods 30, 31 will cause the interior wall pad 28 to move away from or toward the vertical posts 90, 91 (away from or toward the proximal end 13 of the frame 12). The handles 190, 191 may be turned (e.g., clockwise when viewing the proximal end 13 of the frame 12) to cause the interior wall pad 28 to move into contact with the wall 42 to help secure the perch 10 to the wall 42, e.g., to initially mount the perch 10 to the wall 42 to facilitate further stabilizing of the perch 10 by moving the support arms 16, 17 to cause engagement of the crossbar 22 with the wall 42. The handles 190, 191 may be rotated clockwise to disengage the perch 10 from the wall 42 and/or to accommodate different thicknesses of walls.

The fence posts 32-35 and the rails 38, 39 provide a safety fence. The fence posts 32-35 may be removably connected to the frame 12, e.g., by being received by receiving tubes 202, 203, 204, 205 that are connected to the platform 14 and/or connected to the lower exterior side members 70, 71 and/or the cross members 83, 84, respectively. The receiving tubes 202-205 are disposed, in this example, between the lower exterior side members 70, 71 and between the cross members 83, 84. The rails 38, 39 may be flexible cables as in this example, or may be configured differently, e.g., as rigid bars, chains, etc.

Operation

Figure 5:
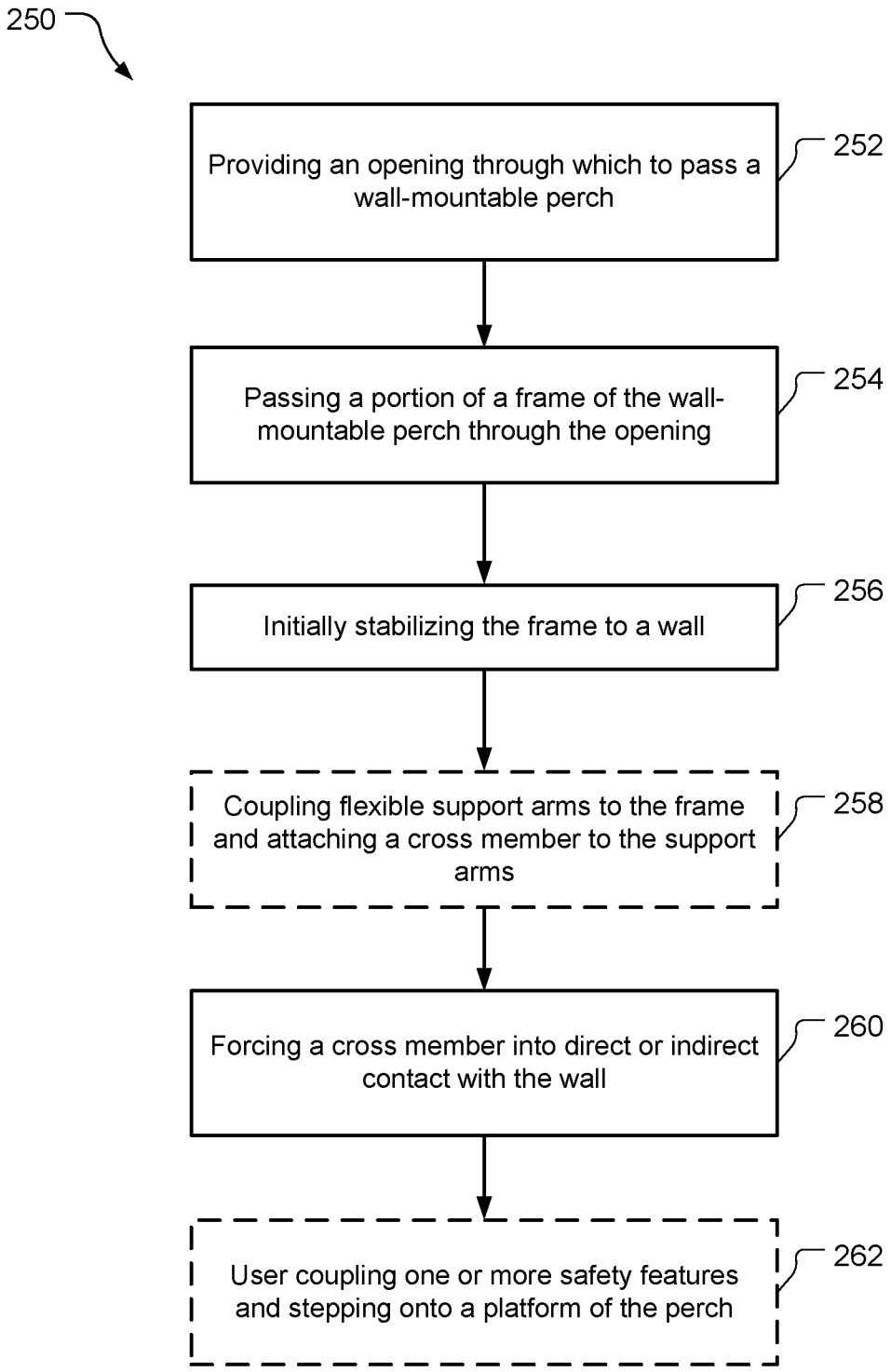
FIG. 5 is a block flow diagram of a method of installing a wall-mountable perch.

Referring to FIG. 5, with further reference to FIGS. 1-4, a method 250 of installing a wall-mountable perch includes the stages shown. The method 250 is, however, an example only and not limiting. The method 250 may be altered, e.g., by having stages added, removed, rearranged, combined, performed concurrently, and/or having single stages split into multiple stages. For example, stage 258 may be omitted, e.g., if support arms are not removable from a frame and a crossbar is not removable from the support arms. Still other alterations to the method 250 as shown and described may be possible.

At stage 252, the method 250 includes providing an opening through which to pass the wall-mountable perch. For example, providing the opening may include removing a window from a window frame to provide the opening 40 in the wall 42, or building the wall 42, e.g., as part of new construction.

At stage 254, the method 250 includes passing a portion of a frame of the wall-mountable perch through the opening. For example, if the fence posts 32-35 are in the receiving tubes, then a user may remove the fence posts from the receiving tubes 202-205. Similarly, if the support arms 16, 17 are in the receiving tubes 110, 112, then the user may remove the support arms from the receiving tubes 110, 112. The user may lift the frame 12 and the attached sill spacer 24, the exterior wall pad 26, and the interior wall pad 28, and pass the distal end 15 of the frame 12 through the window opening 40. The interior wall pad 28 may be removed before inserting the frame 12 through the opening 40, but the user may want to have the interior wall pad 28 connected to the frame 12 to facilitate quickly stabilizing the perch 10 against the wall 42.

At stage 256, the method 250 includes initially stabilizing the frame to the wall. For example, the user maneuvers the frame 12 to place the sill spacer 24 onto a window sill and draws the frame 12 toward the wall so that the exterior wall pad 26 engages the exterior surface of the wall 42. The user pushes the interior wall pad 28 against the interior surface of the wall 42 to clamp the frame 12 to the wall 42. For example, the user turns the handles 190, 191 to turn the clamp rods 30, 31 to force the interior wall pad 28 distally, e.g., toward the exterior wall pad 26. The user may continue, or at least attempt to continue, to turn the handles 190, 191 after the interior wall pad 28 engages the interior surface of the wall 42 to initially stabilize the frame 12 to the wall 42. The interior wall pad 28 and the clamp rods 30, 31, in conjunction with the exterior wall pad 26 and the frame 12, may comprise securing means for securing the perch 10 to the wall 42.

At stage 258, the method 250 includes coupling flexible support arms to the frame and coupling a cross member (e.g., a wall-engaging member) to the support arms. For example, the user inserts bottom portions of the lower sections 122, 128 of the support arms 16, 17 into the receiving tubes 110, 112. The user may, before or after inserting the support arms 16, 17 into the receiving tubes 110, 112, couple the crossbar to the support arms 16, 17. For example, the user slides the crossbar 22 onto the distal ends 151, 152 of the upper sections 120, 126 of the support arms 16, 17. The user may continue to slide the crossbar 22 onto the support arms 16, 17 until further insertion is inhibited, e.g., by the support arms 16, 17 hitting an interior wall of the crossbar 22 (or reaching ends of receiving tubes).

At stage 260, the method 250 includes forcing a cross member into direct or indirect contact with the wall (e.g., directly or indirectly via a spacer as discussed below with respect to FIGS. 9-11). For example, the user may actuate the securing mechanisms to force the upper sections 120, 126 away from the lower sections 122, 128 of the support arms 16, 17 to force the support arms 16, 17 to lengthen. The user may continue to cause the support arms 16, 17 to lengthen after the tension arms 18, 19 begin to resist further elongation of the support arms 16, 17 and exert forces to pull the crossbar 22 horizontally (here, distally relative to the frame 12), causing the support arms 16, 17 to bend distally (toward the distal end 15 of the frame 12). The user may continue to cause the support arms 16, 17 to lengthen until the support arms 16, 17 bend so much that the crossbar 22 engages the wall 42 directly, or engages a spacer placed between the wall and the crossbar 22. The lengths of the tension arms 18, 19 may prevent the support arms 16, 17 from extending higher than a top of the window opening, with the crossbar 22 engaging portions of the wall 42 laterally adjacent to the window opening 40 (on either side of the opening 40). Alternatively, the tension arms may be coupled to the support arms 16, 17 proximally relative to distal ends of the support arms 16, 17 and the support arms 16, 17 sized such that the crossbar 22 may contact the wall 42 above the window opening. The user may continue to actuate, or attempt to actuate, the securing mechanisms 124, 130 to further lengthen, or attempt to further lengthen, the support arms 16, 17 to pull the tension arms 18, 19 taut to further stabilize the frame 12, including the platform 14, relative to the wall 42. The mechanisms 124, 130, in conjunction with the support arms 16, 17 and the frame 12, may provide adjusting means for producing tension in the tension arms 18, 19.

At stage 262, the method 250 includes the user coupling one or more safety features to the perch and stepping onto a platform of the perch. For example, the user may insert the fence posts 32-35 into the receiving tubes 202-205 and attach the rails 38, 39 (if the rails 38, 39 are not already attached) to the fence posts 32-35. One or more other safety features may be connected, such as connecting a harness worn by the user to the frame 12 or to an item (e.g., a ring 155 (FIG. 1), a hook, etc. of the crossbar 22) separate from and coupled to the frame 12. The user may use the cross member 80 as a step, and step on the cross member 80 to pass through (e.g., walk through) the window opening 40 between the support arms 16, 17 onto the platform 14.

Other Configurations

The examples discussed above are non-exhaustive examples and numerous other configurations may be used. The discussion below is directed to some of such other configurations, but is not exhaustive (by itself or when combined with the discussion above).

Figure 6:
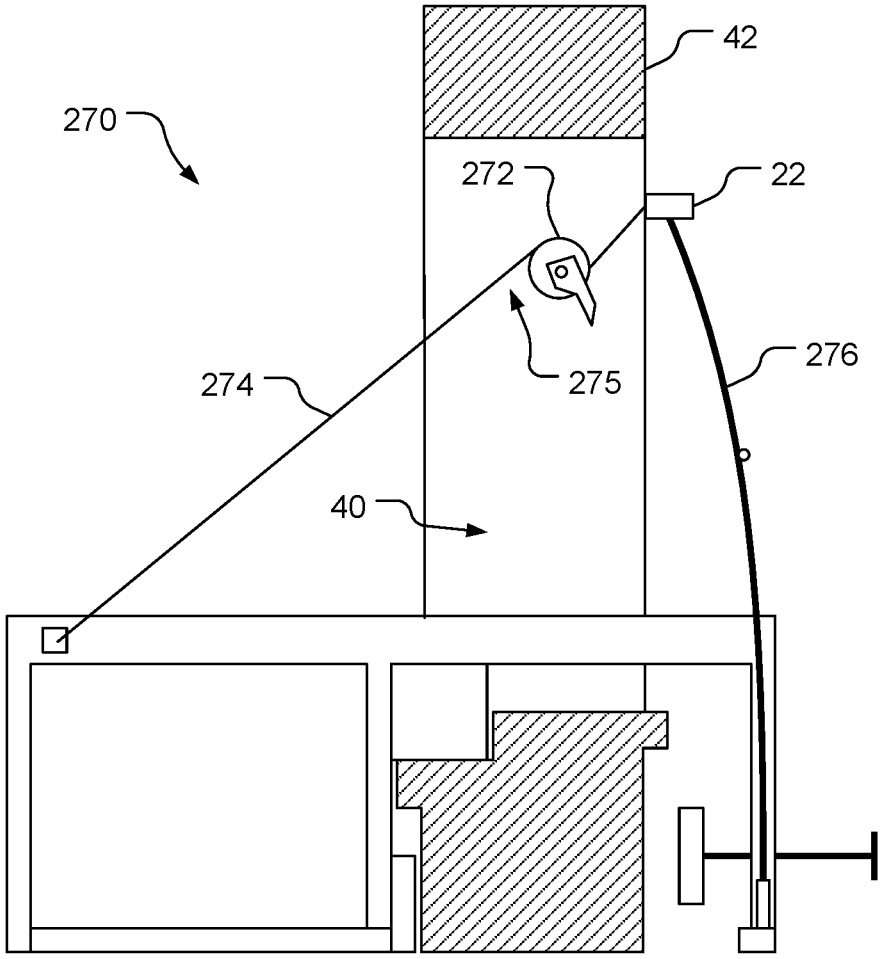
FIG. 6 is a simplified side view of another example perch while extending through a window opening, and with a side portion of a wall providing the window opening removed.

As an example, referring to FIG. 6, with further reference to FIGS. 1-4, instead of, or in addition to, the securing mechanisms 124, 130, a wall-mountable perch 270 may include tensioning mechanisms connected to tension arms and that are configured to adjust effective lengths of the tension arms. Support arms may be fixed-length support arms. Only one tensioning mechanism 272, one tension arm 274, and one support arm 276 are shown in FIG. 6 due to FIG. 6 being a side view. The tension arms may be, for example, flexible cables like the tension arms 18, 19. The tensioning mechanisms may be configured to adjust effective lengths of the tension arms (e.g., distances between the anchor points 164, 165 and the crossbar 22) by winding the tension arms onto a spool of the tensioning mechanisms or unwinding the tension arms from the spool. The effective lengths may be shorted to cause the support arms to bend and the crossbar 22 to contact the wall 42 (as in stage 260 of the method 250). The tensioning mechanisms may, for example, include ratcheting mechanisms. The tensioning mechanisms may be disposed near proximal ends (e.g., a proximal end 275 of the tension arm 274) to facilitate actuation of the tensioning mechanisms by a user standing inside a building while the perch 270 extends through the window opening 40.

Figure 7:
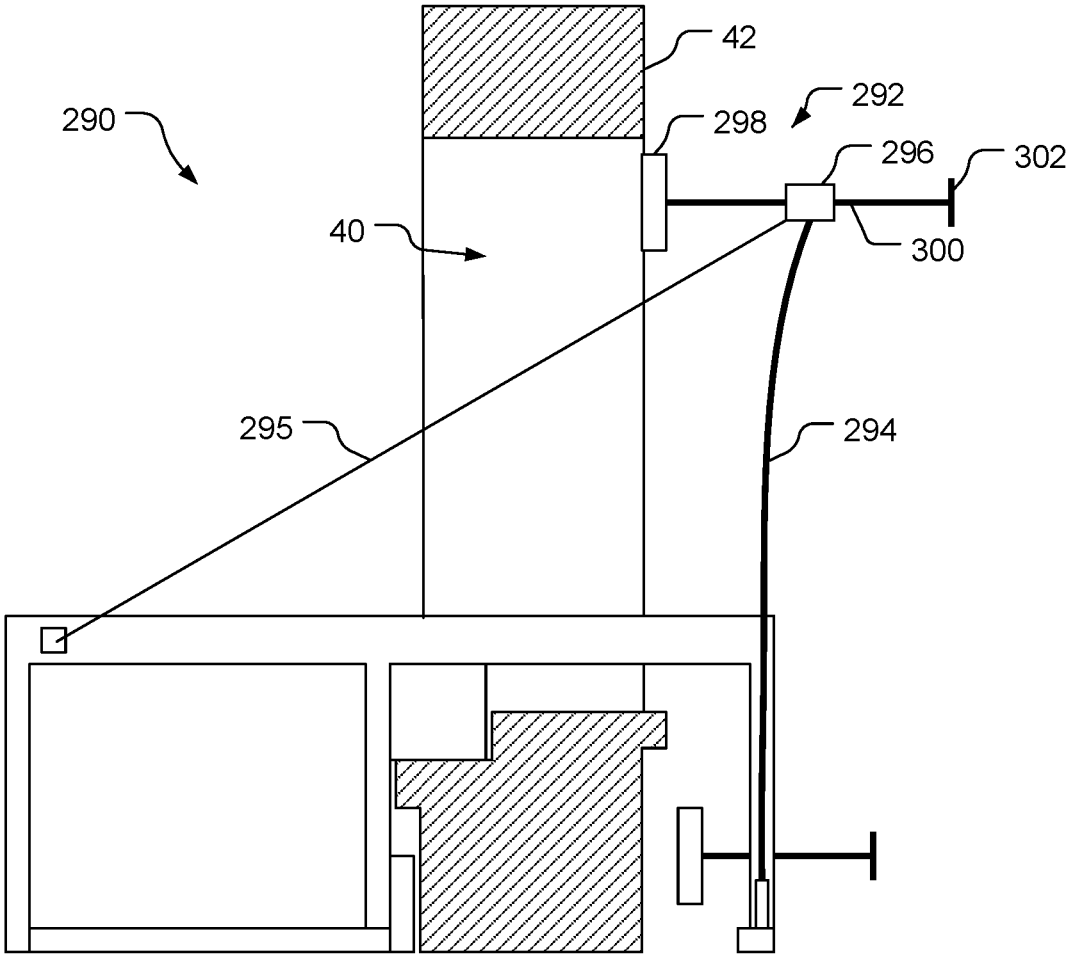
FIG. 7 is a simplified side view of another example perch while extending through a window opening, and with a side portion of a wall providing the window opening removed.

As another example, referring to FIG. 7, with further reference to FIGS. 1-4, instead of, or in addition to, the securing mechanisms 124, 130, a wall-mountable perch 290 may include one or more adjustable spacers that are connected to support arms and/or to a crossbar 296 connected to the support arms. Tensioning arms may be connected to the support arms and/or to the crossbar (if the crossbar is present, as in this example). Only one adjustable spacer 292, one support arm 294, and one tensioning arm 295 are shown in FIG. 7 due to FIG. 7 being a side view. In other configurations, the adjustable spacers and the securing mechanisms 124, 130 (with adjustable-length support arms) may be used. Here, the adjustable spacers are movably connected to the crossbar 296, but other configurations may be used where the adjustable spacers are connected to the support arms, or to the support arms and to the crossbar 296. Further, configurations may be used that do not include the crossbar 296. The adjustable spacers include spacer pads rotatably connected to clamp rods that are connected to handles. As shown, the adjustable spacer 292 includes a spacer pad 298 rotatably connected to a clamp rod 300 that is connected to a handle 302. The spacer pads may comprise a durable material to withstand being in contact with interior wall surfaces such as painted drywall, paneling, tile, etc., while inhibiting damaging (e.g., scratching, marring) the interior wall surface. The spacer pads may be rotatably connected to the clamp rods such that the clamp rods may be rotated without rotating the spacer pads, e.g., when the spacer pads are engaged with the wall 42. The clamp rods are threaded, pass through threaded holes provided by the crossbar 296, and have proximal ends connected to the handles to facilitate a user turning the clamp rods. Turning the clamp rods will cause the spacer pads to move away from or toward the crossbar 296. The handles may be turned (e.g., clockwise when viewing the perch 290 from a proximal end) to cause the spacer pads to move into contact with the wall 42 (for stage 260 of the method 250) to help secure the perch 290 to the wall 42. With the spacer pads engaged with the wall 42, the handles may be rotated more to increase tension in tension arms (that may be flexible cables like the tension arms 18, 19) and possibly to bend the support arms away from the wall 42 (e.g., as shown in FIG. 7 with the support arm 294 bending away from the wall 42). The handles may be turned until the tension arms are taut.

As another example, a perch platform may be at, or nearly at, the same height as a window sill when the perch is mounted to a wall through a window opening. For example, the vertical posts 94, 95, and the lower exterior side members 70, 71, and the cross member 84 of the frame 12 may be omitted from a perch. In this case, the platform 14 may be supported by, and span the gap between, the side members 60, 61 and the cross members 81, 82. Alternatively, the vertical posts 92, 93 and the cross member 83 may also be omitted. In this case, an alternative configuration for providing the exterior wall pad 26 may be used. For example, arms may be connected to the side members 60, 61 (e.g., (midway) between the proximal ends 62, 63 and the distal ends 64, 65) and extend downward and proximally (i.e., toward the proximal end 13 of the frame 12) and be connected to one or more exterior wall pads. A cross member may or may not be connected between these arms.

As other examples, other configurations of mechanisms may be used to engage an interior of the wall 42 to initially clamp a perch to the wall 42. For example, rotatable arms may be connected to one or more wall-engaging pads. The rotatable arms may be ratcheted so that the arms may be forced to rotate so that the pad(s) engage the wall. Further rotation or attempted rotation may increase pressure applied by the pad(s) to the wall while ratcheting mechanism(s) inhibit the pressure from being released. For example, the clamp rods 30, 31 may be replaced with ratcheting rotating rods.

Figure 8:
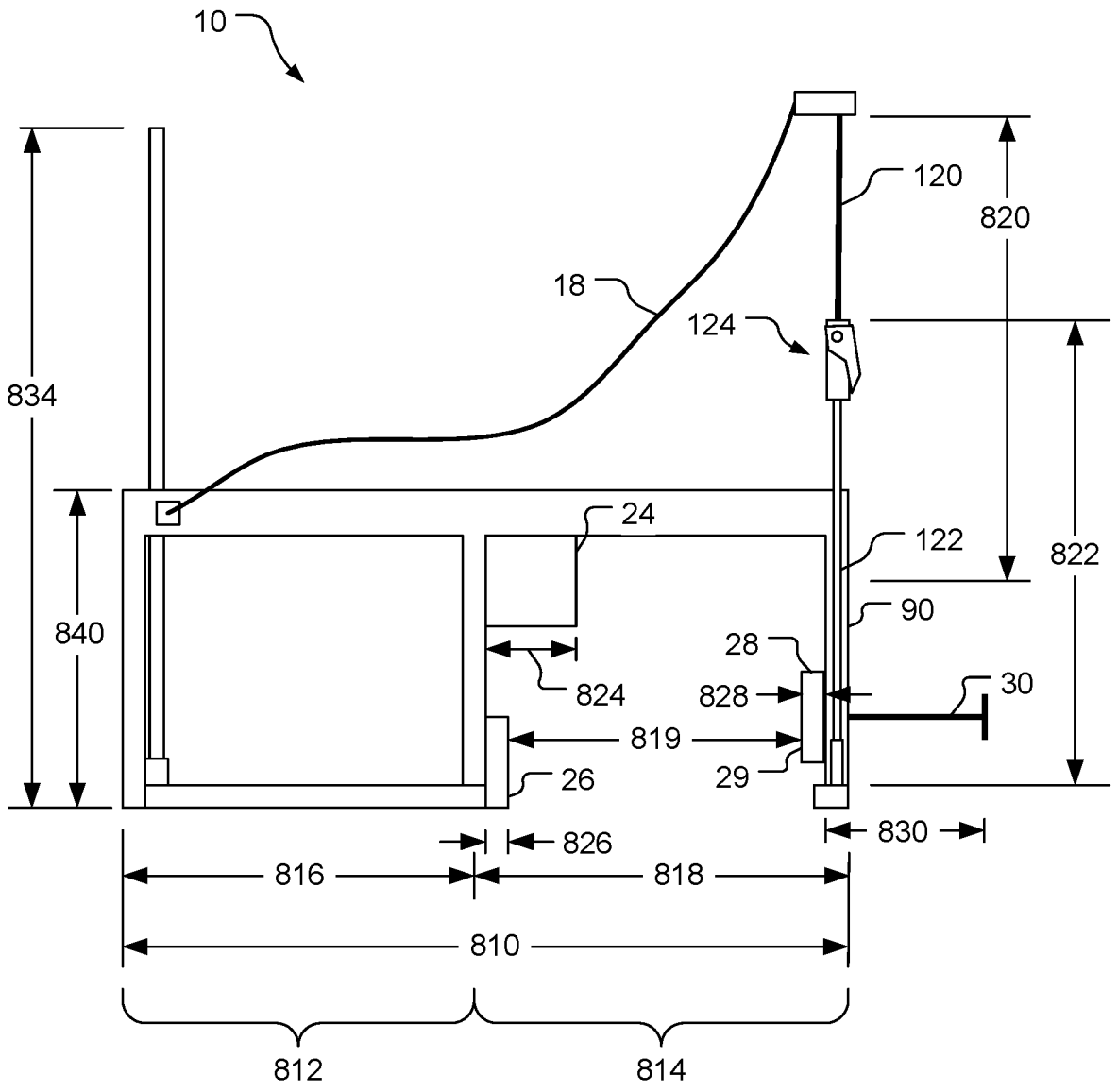
FIG. 8 is a side view of the perch shown in FIG. 1.

Perches may have a variety of different absolute and/or relative sizes. For example, referring again to FIGS. 1-4, and referring to FIG. 8, the perch 10 may have a length 810 of about 120 cm. A distal portion 812 and a proximal portion 814 may each be about half (e.g., 45%-55%) of the length 810 of the perch 10, e.g., having lengths 816, 818 of about 60 cm each. The lengths 816, 818 may be the same or different, e.g., with the length 818 being chosen to accommodate desired thicknesses of walls to be straddled by the perch 10. A thickness 824 of the sill spacer 24, a thickness 826 of the exterior wall pad 26, a thickness 828 of the interior wall pad 28, and a length 830 of the clamp rods 30, 31 may be selected in conjunction with the length 818 of the proximal portion 814 in order to accommodate desired wall thicknesses to be straddled by the perch 10. For example, with the length 818 being about 20 cm, the thicknesses 824, 826, 828 may be about 3 cm, about 8.5 cm, and about 3 cm, respectively, including a cushion providing an interior wall 29 of the interior wall pad 28 to help prevent damaging a surface of the wall 42, and the length 830 may be about 25 cm. The length 830 may be about half of the length 818 (here about 25 cm versus about 60 cm, and thus about 42% of the length 818). The length 830 may be about half a distance 819 between the exterior wall pad 26 and the interior wall pad 28 with the interior wall pad against the vertical posts 90, 91. In this example, the distance 819 is about 52 cm and the length 830 is about 25 cm. The length 830 could be another absolute length or another length relative to the perch 10 or the perch frame 12, e.g., over half the distance 819, or even over half the length 818. The width 100 (FIG. 4) may, for example, be about 60 cm and a height 840 of the frame 12 may be about 36 cm. Thus, in this example, the height 840 is about 30% of the length 810 of the perch 10, or about 60% of each of the portions 812, 814. Lengths 834 of the fence posts 32-35 may be selected to allow the rails 38, 39 to be at heights to help prevent a worker from falling from the perch 10. For example, the lengths 834 may be about 2.5 times the height 840 of the frame 12, e.g., about 90 cm. The horizontal side members 50, 51, 60, 61 and the cross member 80 may be about 5 cm wide and about 2.5 cm thick (e.g., metal tubes 5 cm by 2.5 cm). The cross members 81-84 and the vertical posts 90-94 and the horizontal members 81-84 may be about 2 cm by about 2 cm (or other shapes/dimensions such as about 2.5 cm by about 2.5 cm). The lower sections 122, 128 of the support arms 16, 17 may each have a length 822 of about 90 cm, and may be tubular, e.g., with a circular cross section with an outside diameter of about 2.6 cm an inside diameter of about 2.4 cm. The upper sections 120, 126 may each have a length 820 of about 90 cm (a portion of the upper section 120 being disposed in the lower section 122 in FIG. 8). The upper sections 120, 126 and the lower sections 122, 128 are configured such that the upper sections 120, 126 may slide within the lower sections 122, 128. For example, the upper sections 120, 126 may have circular cross sections with outer diameters of about 2.4 cm. The tension arms 18, 19 may be long enough that the support arms 16, 17 may be fully extended without the tension arms 18, 19 being taut. For example, lengths of the tension arms 18, 19 may be between about 100%, or about 110%, of a hypotenuse of a right triangle with one orthogonal side having a length equal to a distance from the anchor point 164 to the support arm 16, and another orthogonal side having a length of a distance from a top of the frame 12 to the crossbar 22 with the support arms 16, 17 fully extended. Here, for example, the lengths of the tension arms 18, 19 may be about 170 cm. The absolute and relative dimensions provided herein are examples only, and other absolute and/or relative dimensions may be used, e.g., to use the perch 10 with different widths and/or heights of window openings and/or different thicknesses of walls.

Figure 9:
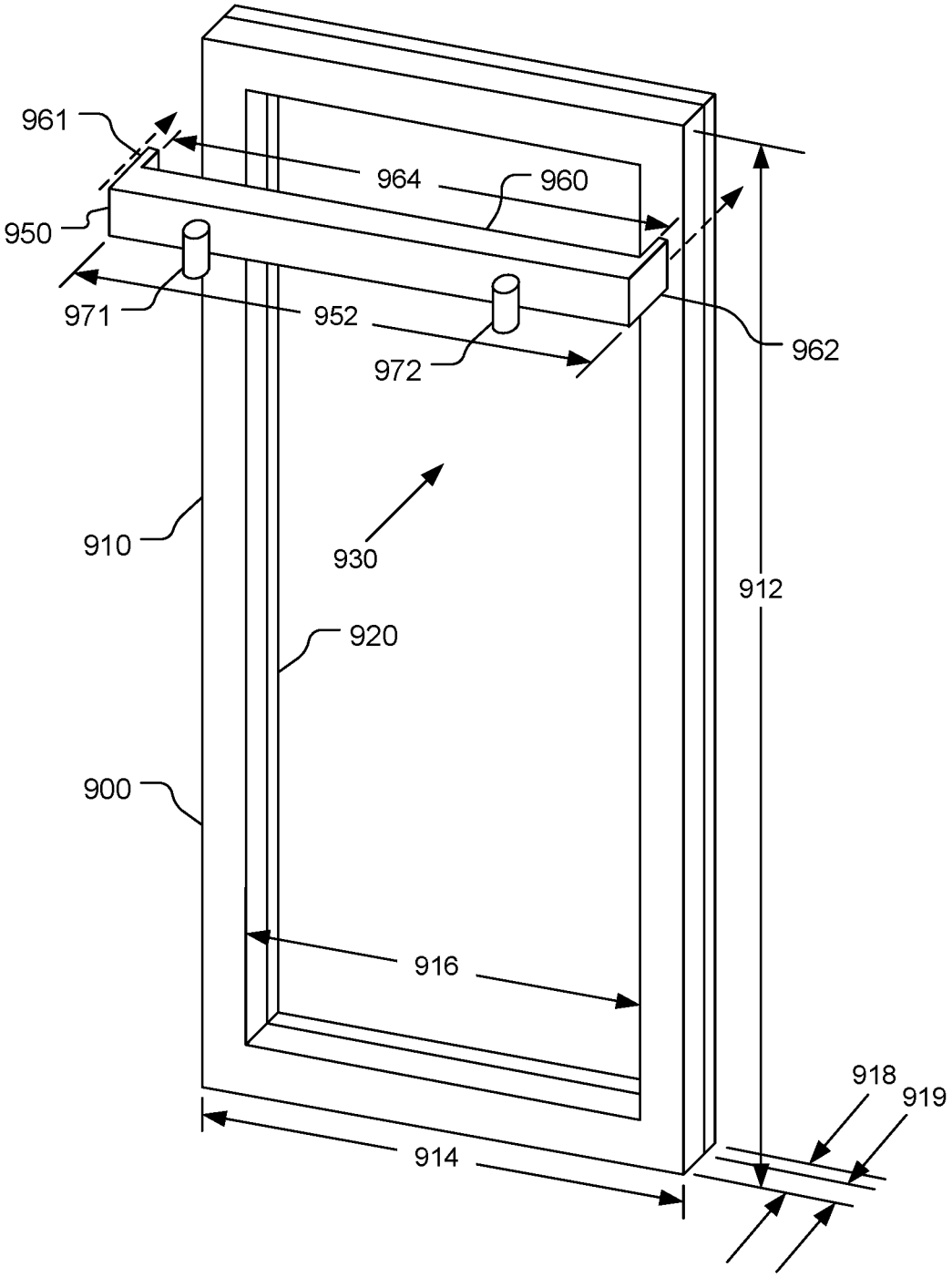
FIG. 9 is a perspective view of a spacer and crossbar of a perch.

Referring to FIG. 9, with further reference to FIGS. 1 and 2, a perch (such as the perch 10) may include a spacer 900 and a crossbar 950, although the spacer 900 and the crossbar 950 may be separable from other portions of the perch. The spacer 900 includes a frame 910 and a cushion 920. The frame 910 may be sized and shaped to be placed about a window opening and to allow a user to pass through an opening 930 provided by the spacer 900, e.g., to reach the platform 14. For example, the frame 910 may have a length 912 of about 240 cm, an exterior width 914 of about 90 cm, and an interior width 916 of about 80 cm that is (slightly) larger than the width 100, allowing the frame 12 to pass through the spacer 90. The frame 910 is configured to transfer force from the crossbar 950 to a wall against which the spacer 900 is placed. For example, the frame 910 may be made of rigid material such as steel (e.g., steel tubing). The frame 910 may be a single, monolithic member or multiple members that are rigidly connected (e.g., welded) to form a single piece. The cushion 920 is configured to contact a wall to inhibit damaging the wall when the spacer 900 is forced against the wall. The cushion 920 may be made of a resilient, flexible material such as rubber, foam rubber, carpet, etc. The crossbar 950 may be used instead of the crossbar 22. The crossbar 950 has a width 952 that is longer than the exterior width 914 of the frame 910 and includes flanges 961, 962 disposed on opposite ends of the crossbar 950 extending from a cross member 960 of the crossbar 950. An interior width 964 between the flanges 961, 962 is slightly greater than the exterior width 914 of the frame 910 such that the crossbar 950 may receive the frame 910 and slide along a length of the frame 910 while inhibiting lateral movement of the crossbar 950 relative to the frame 910 (i.e., transverse to the length 912 of the frame 910). The flanges 961, 962 extend from the cross member 960 less than a thickness 918 (e.g., about 3 cm) of the spacer 900, possibly less than a thickness 919 of the frame 910. The crossbar 950 may include receiving tubes 971, 972 that are sized and shaped for receiving the support arms 16, 17 to (loosely) couple the support arms 16, 17 to the crossbar 950.

Figure 10:
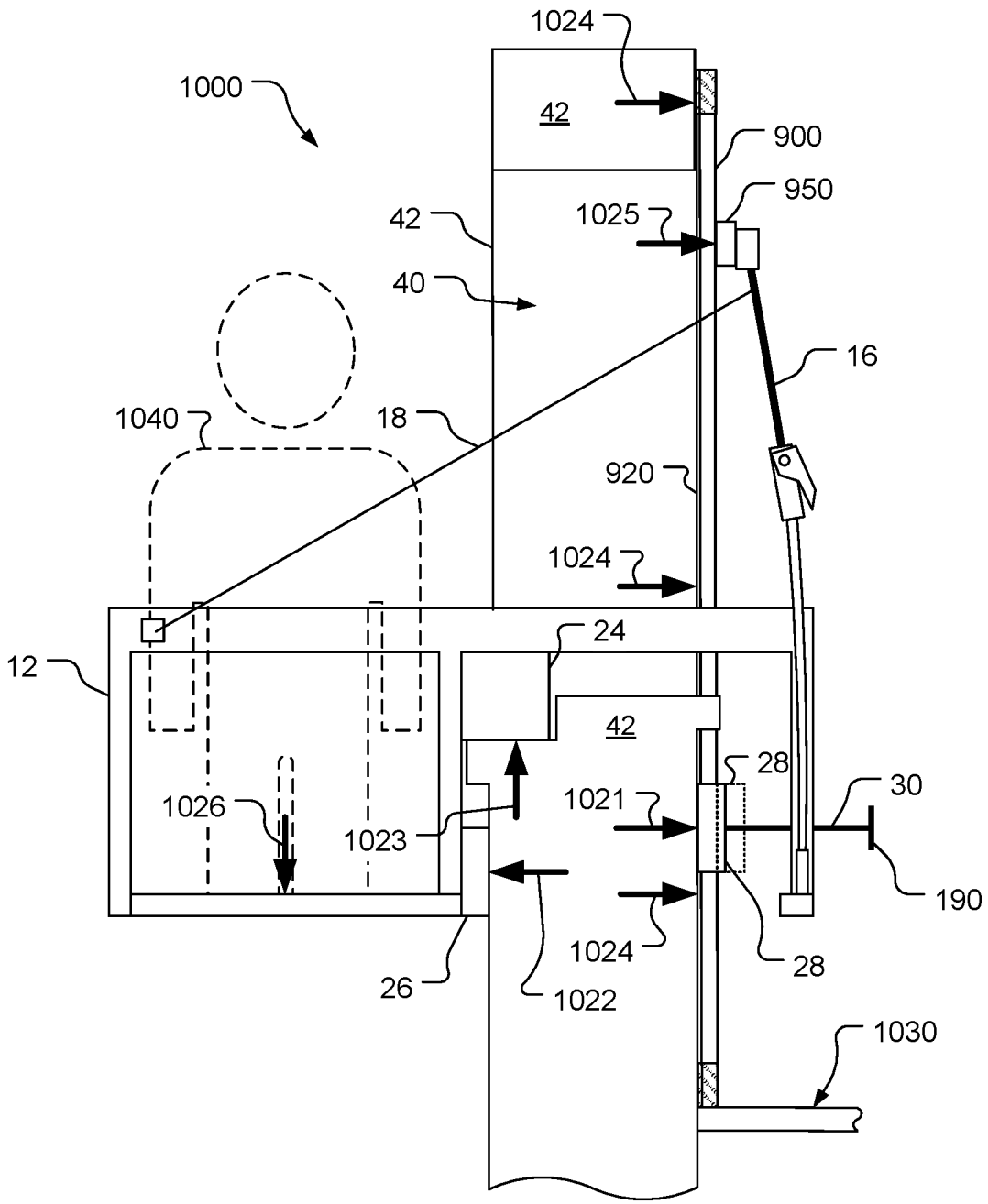
FIG. 10 is a simplified side view of a perch, including the spacer and crossbar shown in FIG. 9, while extending through a window opening.

Referring also to FIG. 10, the spacer 900 may be placed between the wall 42 and the crossbar 950 of a perch 1000, with the cushion 920 against the wall 42, and with the spacer 900 placed adjacent to the window opening 40. The spacer 900 may be rested on a floor 1030 adjacent the window opening 40. The wall 42 is not shown in cross hatch for simplicity of the figure. The perch 1000 is similar to the perch 10, but with the crossbar 22 replaced by the crossbar 950, and the tension arms 18, 19 coupled to the support arms 16, 17. The support arms 16, 17 are received by the receiving tubes 971, 972. The tension arms 18, 19 are connected to the support arms 16, 17 to enable pulling of the crossbar 950 toward the anchor points 164, 165 with the support arms 16, 17 received by the receiving tubes 971, 972. With the exterior wall pad 26 disposed against the wall 42, the interior wall pad 28 pressed against a wall 42 by the clamp rods 30, 31 (pushing against the vertical posts 90, 91), and the spacer 900 pressed against the wall 42 by the tension arms 18, 19 pulling on the support arms 16, 17 and in turn pulling on the crossbar 950, various forces are produced. The wall 42 pushes (laterally) against the interior wall pad 28 with a force 1021. The force 1021 is shown as a single arrow, but represents force provided by the wall 42 across the interior wall pad 28 where the wall 42 contacts the interior wall pad 28. Similarly, other forces are shown by single arrows for sake of simplicity of the figure, but respective forces may be provided across areas, and may vary in intensity over the areas. The wall 42 pushes (laterally) against the exterior wall pad 26 with a force 1022 and may push (upwardly) against the sill spacer 24 with a force 1023. The wall 42 pushes (laterally) against the spacer 900 with a force 1024. While only three arrows are shown for the force 1024 (one at the top of the spacer 900, one at the bottom of the spacer 900, and one between the top and bottom of the spacer 900), the wall 42 may push against the spacer 900 over a large area, e.g., wherever the wall 42 contacts the spacer 900, although the force 1024 may not be evenly distributed (e.g., being greater near the crossbar 950). The spacer 900 in turn pushes against the crossbar 950 with a force 1025.

Forces produced by the perch 1000, and in turn forces produced by walls on the perch 1000, help stabilize the perch 1000 relative to the walls. The forces 1021-1025 work in concert to resist movement (e.g., lateral, up-and-down, and/or rotational movement) of the perch 1000. The perch 1000 produces equal and opposite forces against the wall 42. The forces 1021-1023 are produced with the perch 1000 mounted to the wall 42, and a force similar to the force 1025 will be produced against the crossbar 22 (although not shown in FIG. 2). The perch 1000 provides means for producing forces against the wall 42 to resist movement of the perch 1000 relative to the wall 42. For example, the interior wall pad 28 and the clamp rods 30, 31 in conjunction with the frame 12 provide means for producing a force against an interior surface of the wall 42 below the window opening 40, e.g., a force opposite the force 1021. As another example, the exterior wall pad 26 in conjunction with the frame 12 (and possibly the interior wall pad 28, the clamp rods 30, 31, and the frame 12) provide means for producing a force against an exterior surface of the wall 42 below the window opening 40, e.g., a force opposite the force 1022. As another example, the support arms 16, 17, the crossbar 22 or the crossbar 950, and the tension arms 18, 19 in conjunction with the frame 12 provide means for producing an inward force on an interior surface of the wall 42 above a bottom of the window opening 40 (above the window sill), e.g., a force opposite the force 1025. The exterior wall pad 26 and the interior wall pad 28 form a clamp and thus means for clamping the perch 1000 to the wall 42. The force 1024 may counteract a force 1026 produced by a weight of a user 1040 standing on the platform 14, e.g., producing counteracting rotational forces on the perch 1000.

The interior wall pad 28 may be sized to contact a spacer, e.g., the spacer 900, and thus contact the wall 42 indirectly instead of directly. For example, a width 27 (FIG. 1) of the interior wall pad 28 may be wider than the width 100 (FIG. 4) of the frame 12 and wider than an interior spacer width, e.g., wider than the interior width 916 of the spacer 900. The interior wall pad 28 could be pressed against the spacer 900 (as shown in dotted lines in FIG. 10) to produce the force 1021. This may help prevent damage to the wall 42.

Figure 11:
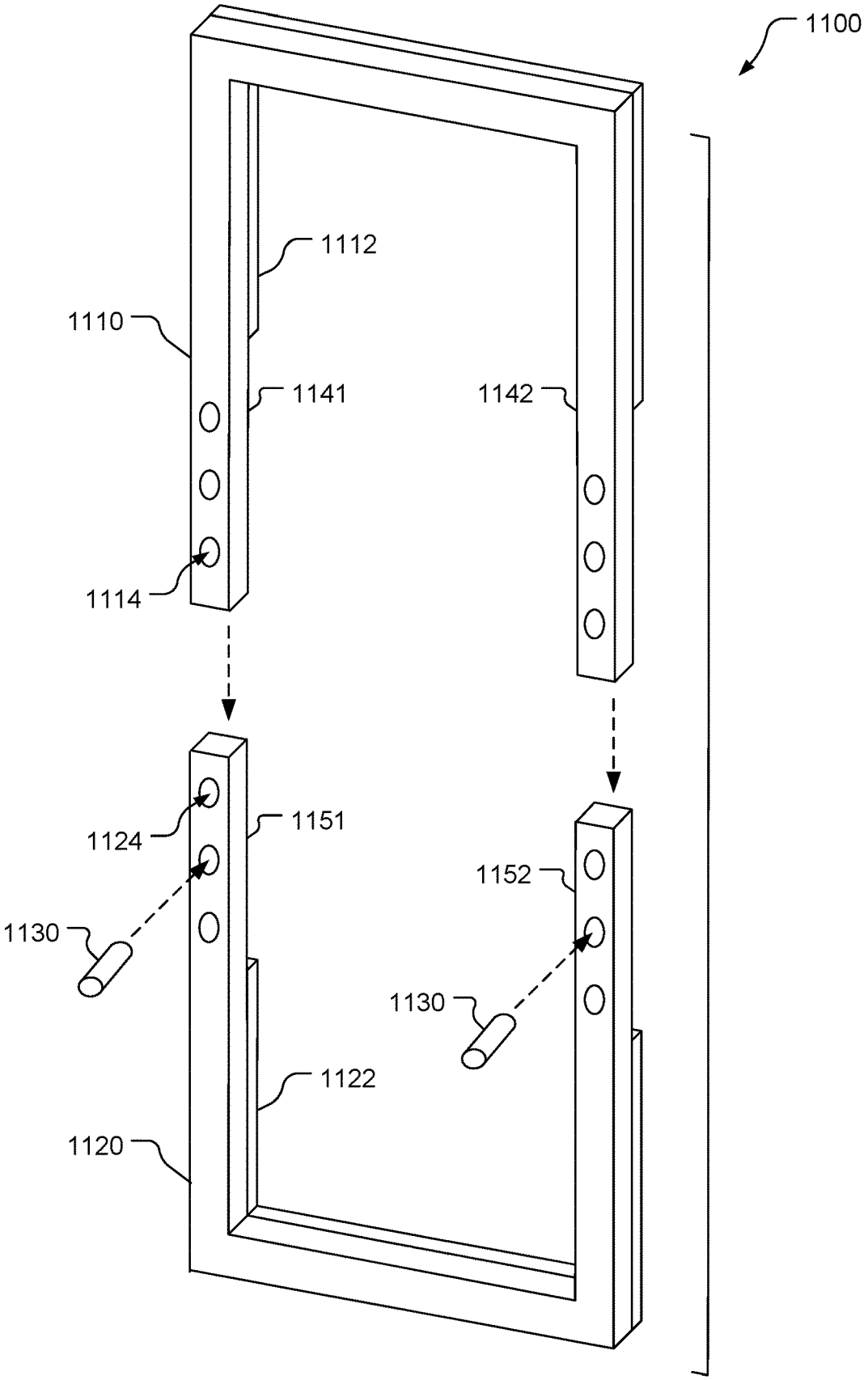
FIG. 11 is a perspective view of an adjustable-length spacer of a perch.

Referring also to FIG. 11, configurations of spacers, other than the configuration of the spacer 900, may be used. For example, spacers may be used that have an adjustable length and/or an adjustable width. As shown in FIG. 11, an adjustable-length spacer 1100 includes an upper frame member 1110 and a lower frame member 1120. The frame members 1110, 1120 may be attached to cushion portions 1112, 1122, respectively. Various configurations may be used to adjust a length of a spacer. In this example, arms 1141, 1142 of the upper frame member 1110 and arms 1151, 1152 of the lower frame member 1120 are configured (sized and shaped) such that the arms 1141, 1142 of the upper frame member 1110 may be received by the arms 1151, 1152 of the lower frame member 1120. The members 1110, 1120 define openings 1114, 1124, respectively. The arms 1141, 1142, 1151, 1152 may be slid with respect to each other to select a desired length of the spacer 1100 from multiple desired lengths providable by the combinations of the openings 1114 and the openings 1124 (with respective openings 1114, 1124 aligned). Pins 1130 are sized and shaped in conjunction with the openings 1114, 1124 to be slidably received by the openings 1114, 1124 to fix the spacer 1100 at a desired length. With the spacer 1100 at a desired length, the pins 1130 may be inserted through aligned combinations of the openings 1114, 1124 to retain the length of the spacer 1100. Quantities and arrangements of the openings 1114, 1124 shown are examples only and not limiting of the disclosure. More or fewer openings than shown may be used. For example, a single opening may be provided by each arm of one of the frame members. As another example, multiple openings in the arms of one of the members may be evenly spaced from each other and multiple openings in the arms of the other member may be unevenly spaced from each other (but provided at similar locations in each of the aims of the same frame member). This may help provide different lengths of the spacer 1100.

Still other configurations may be used.

Other Considerations

The techniques and discussed above are examples, and not exhaustive. Configurations other than those discussed may be used.

As used herein, "or" as used in a list of items prefaced by "at least one of" or prefaced by "one or more of" indicates a disjunctive list such that, for example, a list of "at least one of A, B, or C," or a list of "one or more of A, B, or C" means A or B or C or AB or AC or BC or ABC (i.e., A and B and C), or combinations with more than one feature (e.g., AA, AAB, ABBC, etc.).

As used herein, the singular forms "a," "an," and "the" include the plural forms as well, unless the context clearly indicates otherwise. For example, "an arm" may include one arm or multiple arms. The terms "comprises," "comprising," "includes," and/or "including," as used herein, specify the presence of stated features, integers, steps, operations, elements, and/or components, but do not preclude the presence or addition of one or more other features, integers, steps, operations, elements, components, and/or groups thereof.

The systems and devices discussed above are examples. Various configurations may omit, substitute, or add various procedures or components as appropriate. For instance, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of example configurations (including implementations). However, configurations may be practiced without these specific details. This description provides example configurations only, and does not limit the scope, applicability, or configurations of the claims. Rather, the preceding description of the configurations provides a description for implementing described techniques. Various changes may be made in the function and arrangement of elements without departing from the spirit or scope of the disclosure.

The invention claimed is:

1. A wall-mountable perch comprising:

a frame configured to be inserted through a window opening in a wall, the frame comprising:

first horizontal side members;

a first cross member connected to each of the first horizontal side members proximate to a respective distal end of each of the first horizontal side members; and second horizontal side members connected to the first horizontal side members;

a frame spacer comprising a plurality of elongated vertical spacer members and a plurality of elongated horizontal spacer members, wherein the plurality of elongated vertical spacer members are disposed further apart from each other than the first horizontal side members are displaced from each other;

a first lower wall brace connected to the frame and providing a first vertical surface;

a second lower wall brace providing a second vertical surface opposing the first vertical surface, the second lower wall brace being laterally movably connected to the frame to move the second vertical surface into contact with the frame spacer to bias the frame spacer against a second side of the wall, with the frame disposed through the frame spacer and through the window opening in the wall and the first lower wall brace in contact with a first side of the wall, opposite the second side of the wall;

a platform connected to the second horizontal side members;

a plurality of support arms each having a proximal end connected proximate to a proximal end of the frame, each support arm of the plurality of support arms extending vertically upward from the frame;

tension arms each connected to a respective horizontal side member of the second horizontal side members; and adjusting means for producing tension in the tension arms and for causing an upper wall brace of the wall-mountable perch to move laterally relative to the frame and into contact with the plurality of elongated vertical spacer members to bias the plurality of elongated vertical spacer members and the plurality of elongated horizontal spacer members against the wall with the frame disposed through the window opening in the wall;

wherein the first lower wall brace, the second lower wall brace, and the upper wall brace provide at least three lateral contact points for opposing sides of the wall, with at least a first one of the at least three lateral contact points corresponding to the first side of the wall and at least a second one of the at least three lateral contact points corresponding to the second side of the wall, each of the at least three lateral points of contact corresponding to a respective combination of vertical location and side of the wall.

2. The wall-mountable perch of claim 1, wherein the plurality of support arms is configured such that a respective length of each of the plurality of support arms is adjustable, and wherein the adjusting means are for forcibly increasing the respective length of each of the plurality of support arms.

3. The wall-mountable perch of claim 1, wherein the tension arms are configured such that a respective effective length of each of the plurality of support arms is adjustable, and wherein the adjusting means are for forcibly decreasing a respective effective length of each of the tension arms.

4. The wall-mountable perch of claim 1, wherein the adjusting means are for forcibly moving the plurality of support arms away from the platform with the upper wall brace of the wall-mountable perch in direct or indirect contact with the wall.

5. The wall-mountable perch of claim 1, wherein the upper wall brace comprises a rigid brace coupled to each of the plurality of support arms.

6. The wall-mountable perch of claim 5, wherein the first cross member connected to each of the first horizontal side members defines a frame width, and wherein the rigid brace has a brace length that extends horizontally beyond the frame width.

7. The wall-mountable perch of claim 5, wherein the rigid brace comprises a plurality of tubes configured to receive the plurality of support arms.

8. The wall-mountable perch of claim 5, wherein each of the tension arms is connected to the rigid brace or a respective one of the plurality of support arms.

9. The wall-mountable perch of claim 1, wherein a proximal end of each of the second horizontal side members is connected to a respective one of the distal ends of the first horizontal side members, and wherein each of the tension arms is connected to a respective one of the second horizontal side members proximate to a respective distal end of the respective one of the second horizontal side members.

10. The wall-mountable perch of claim 1, wherein the wall-mountable perch comprises a sill spacer attached to a bottom side of each of the first horizontal side members.

11. The wall-mountable perch of claim 1, further comprising:

vertical posts having first ends connected to the distal ends of the first horizontal side members, the vertical posts extending downwardly from the first horizontal side members to distal ends of the vertical posts;

wherein the first lower wall brace comprises an exterior wall contact member attached to the vertical posts and configured to contact an exterior of the wall.

12. The wall-mountable perch of claim 11, wherein the second horizontal side members comprise an upper pair of horizontal side members and a lower pair of horizontal side members, the upper pair of horizontal side members being attached to the distal ends of the first horizontal side members, the lower pair of horizontal side members being attached to the distal ends of the vertical posts, and wherein the platform is attached to and spans a gap between the lower pair of horizontal side members.

13. The wall-mountable perch of claim 1, wherein each support arm of the plurality of support arms is configured to have the respective distal end move horizontally parallel to a direction from the proximal end of the frame toward a distal end of the frame.

14. The wall-mountable perch of claim 1, wherein the adjusting means are for causing the upper wall brace of the wall-mountable perch to move into contact with the frame spacer to bias the frame spacer against the second side of the wall with the frame disposed through the frame spacer and through the window opening in the wall.

15. A wall-mountable perch comprising:

a frame comprising:

a plurality of horizontal side members;

a first cross member connected to each of the plurality of horizontal side members displaced from a respective distal end of each of the plurality of horizontal side members and from a respective proximal end of each of the plurality of horizontal side members;

a second cross member connected proximate to the respective distal end of each of the plurality of horizontal side members;

a platform support connected to the plurality of horizontal side members by a plurality of vertical frame members; and a plurality of frame posts each connected to and extending downward from a respective one of the plurality of horizontal side members, and each disposed toward the proximal ends of the plurality of horizontal side members relative to the first cross member;

a platform connected to the platform support;

a plurality of fence posts connected to, and extending vertically upward from, the frame;

a plurality of adjustable-length support arms each having a proximal end connected to a respective proximal end of each of the plurality of horizontal side members, each of the plurality of adjustable-length support arms extending vertically upward from a respective one of the plurality of horizontal side members;

a frame spacer comprising a plurality of elongated vertical spacer members and a plurality of elongated horizontal spacer members, wherein the plurality of elongated vertical spacer members are disposed further apart from each other than the plurality of adjustable-length support arms are displaced from each other;

an upper wall brace coupled to each of the plurality of adjustable-length support arms;

a plurality of tension arms each connected to a respective horizontal side member of the plurality of horizontal side members and each connected to the upper wall brace; and a lower wall brace laterally movably connected to the plurality of frame posts to move horizontally relative to the plurality of frame posts;

wherein each of the plurality of adjustable-length support arms is configured to move the upper wall brace laterally toward distal ends of the plurality of horizontal side members, and into contact with the frame spacer to bias the plurality of elongated vertical spacer members and the plurality of elongated horizontal spacer members, due to tension provided by the plurality of tension arms as a length of each the plurality of adjustable-length support arms is increased.

16. The wall-mountable perch of claim 15, wherein the plurality of tension arms comprises flexible cables.

17. The wall-mountable perch of claim 15, wherein each of the plurality of adjustable-length support arms comprises a ratchet mechanism configured to extend the respective adjustable-length support arm of the plurality of adjustable-length support arms.

18. The wall-mountable perch of claim 15, wherein the plurality of fence posts is disposed between the plurality of horizontal side members and between the first cross member and the second cross member.

19. The wall-mountable perch of claim 15, further comprising a spacer, the upper wall brace and the spacer being configured to have the upper wall brace slidably receive the spacer such that the upper wall brace may slide along a length of the spacer transverse to the first cross member and have limited range of motion relative to the spacer in a direction transverse to the length of the spacer.

20. A method of installing a wall-mountable perch comprises:

passing a portion of a frame of the wall-mountable perch through an opening defined by a wall;

disposing vertical arms and horizontal arms of a frame spacer between a cross member of the wall-mountable perch and the wall laterally outside of the opening;

stabilizing the frame to the wall defining the opening by moving a first wall brace of the wall-mountable perch into lateral contact with a first side of the wall and moving a second wall brace of the wall-mountable perch laterally relative to a frame of the wall-mountable perch into contact with the vertical arms of the frame spacer to bias the frame spacer against a second side of the wall, opposite the first side of the wall; and forcing a cross member of the wall-mountable perch into contact with the vertical arms of the frame spacer to bias the vertical arms and the horizontal arms of the frame spacer against the wall by moving the cross member of the wall-mountable perch laterally with respect to the frame of the wall-mountable perch, such that the wall-mountable perch has at least three lateral points of contact with the wall, with at least a first one of the at least three lateral points of contact with the wall being with the first side of the wall and at least a second one of the at least three lateral points of contact with the wall being with the second side of the wall, each of the at least three lateral points of contact corresponding to a respective combination of vertical location and side of the wall.

* * * * *